US010351276B2

(12) United States Patent
Monti

(10) Patent No.: US 10,351,276 B2
(45) Date of Patent: Jul. 16, 2019

(54) TRANSFER DEVICE OF INFORMATION LEAFLETS

(71) Applicant: MARCHESINI GROUP S.p.A., Pianoro (Bologna) (IT)

(72) Inventor: Giuseppe Monti, Pianoro (IT)

(73) Assignee: MARCHESINI GROUP S.P.A., Pianoro (Bologna) (IT)

( * ) Notice: Subject to any disclaimer, the term of this patent is extended or adjusted under 35 U.S.C. 154(b) by 379 days.

(21) Appl. No.: 15/102,167

(22) PCT Filed: Dec. 11, 2014

(86) PCT No.: PCT/IB2014/066798

§ 371 (c)(1),
(2) Date: Jun. 6, 2016

(87) PCT Pub. No.: WO2015/087272

PCT Pub. Date: Jun. 18, 2015

(65) Prior Publication Data

US 2016/0304225 A1 Oct. 20, 2016

(30) Foreign Application Priority Data

Dec. 13, 2013 (IT) ..... 2013A0685

(51) Int. Cl.
*B65B 25/14* (2006.01)
*B65B 35/16* (2006.01)
(Continued)

(52) U.S. Cl.
CPC ..... *B65B 25/145* (2013.01); *B65B 5/06* (2013.01); *B65B 35/16* (2013.01); *B65B 35/243* (2013.01);
(Continued)

(58) Field of Classification Search
CPC ..... B65B 25/145; B65B 5/06; B65B 35/16; B65B 35/243; B65B 35/40; B65B 35/44;
(Continued)

(56) References Cited

U.S. PATENT DOCUMENTS 2,728,178 A * 12/1955 Kern ..... B43M 5/042 270/45
4,059,264 A * 11/1977 Vogel ..... B65B 61/20 270/32
(Continued)

FOREIGN PATENT DOCUMENTS

CN 202 464 245 U 10/2012
EP 0771675 A1 * 5/1997 ..... B42C 19/08

*Primary Examiner* — Stephen F. Gerrity
*Assistant Examiner* — David G Shutty
(74) *Attorney, Agent, or Firm* — R. Neil Sudol; Henry D. Coleman

(57) ABSTRACT

A device for transferring leaflets from an upper level to a lower level, where packing apparatus work stations insert the leaflets into boxes together with product, includes at least two belts loop-wound to have two opposed branches defining a substantially vertical straight section and a deflector at the upper level to turn leaflets from an incoming horizontal orientation drawn to draw the leaflets to assume a vertical orientation between the opposed belt branches of the straight vertical section. A drum rotatable about a rotation axis bears two gripping arms for extracting the leaflets in seriatim from the straight section and transferring the leaflets to respective grippers borne by a conveyor to transfer the leaflets to the packing apparatus work stations.

5 Claims, 7 Drawing Sheets

(51) Int. Cl.

| | |
|---|---|
| ***B65B 35/24*** | (2006.01) |
| ***B65B 35/40*** | (2006.01) |
| ***B65B 35/50*** | (2006.01) |
| ***B65B 5/06*** | (2006.01) |
| ***B65B 61/20*** | (2006.01) |
| ***B65B 35/44*** | (2006.01) |
| ***B65B 43/52*** | (2006.01) |

(52) U.S. Cl.
CPC ..... *B65B 35/40* (2013.01); *B65B 35/44* (2013.01); *B65B 35/50* (2013.01); *B65B 43/52* (2013.01); *B65B 61/20* (2013.01); *B65B 2220/14* (2013.01); *B65B 2220/18* (2013.01)

(58) Field of Classification Search
CPC ..... B65B 35/50; B65B 43/52; B65B 61/20; B65B 2220/14; B65B 2220/18
See application file for complete search history.

(56) References Cited

U.S. PATENT DOCUMENTS 4,161,092 A * 7/1979 Buday ..... B65B 25/141 53/244
4,161,095 A * 7/1979 Buday ..... B65B 25/143 53/244
4,351,679 A * 9/1982 Dreher ..... B65B 61/202 156/70
4,482,141 A * 11/1984 Moser ..... B65H 5/32 198/644
4,518,156 A * 5/1985 Moser ..... B65H 5/32 198/470.1
4,845,921 A * 7/1989 Miselli ..... B65B 35/54 53/453
4,902,184 A * 2/1990 Fritz ..... B65G 57/14 414/790.3
5,157,896 A * 10/1992 Tisma ..... B65B 35/16 53/157
5,467,976 A * 11/1995 Doucet ..... B65H 29/58 271/184
5,542,547 A * 8/1996 Ricciardi ..... B07C 3/08 198/370.01
6,082,079 A * 7/2000 Kuehl ..... B65B 61/20 53/520
6,226,959 B1 * 5/2001 Krasuski ..... B43M 5/042 53/117
6,446,416 B1 * 9/2002 Kuhn ..... B65B 35/56 198/802
6,612,559 B2 * 9/2003 Boss ..... B42B 2/00 198/644
6,736,061 B2 * 5/2004 Caunter ..... B65H 5/32 101/227
6,789,793 B2 * 9/2004 Caunter ..... B65H 5/32 270/49
7,669,385 B2 * 3/2010 Sichera ..... B65B 25/002 53/157
7,673,436 B2 * 3/2010 Bershadsky ..... B65G 47/26 198/460.2
9,315,354 B2 * 4/2016 Tommasi ..... B65H 29/40
2003/0217656 A1 * 11/2003 Caunter ..... B65H 5/32 101/228
2004/0068961 A1 * 4/2004 Chalendar ..... B65B 61/207 53/398
2004/0206053 A1 * 10/2004 Herkel ..... B65B 59/00 53/458
2005/0166550 A1 * 8/2005 Biondi ..... B65B 61/20 53/415
2005/0179195 A1 * 8/2005 Saurer ..... B65B 57/14 271/198
2005/0218585 A1 * 10/2005 Saurer ..... B65B 61/20 271/204
2005/0225023 A1 * 10/2005 Schlough ..... B65H 5/12 271/69
2005/0235604 A1 * 10/2005 Saurer ..... B65B 59/04 53/250
2006/0272298 A1 * 12/2006 Spatafora ..... B65B 19/22 53/540
2008/0196360 A1 * 8/2008 Monti ..... B65B 5/024 53/249
2009/0126322 A1 * 5/2009 Fuellemann ..... B65B 5/024 53/475
2009/0288932 A1 * 11/2009 Curley ..... B65H 5/32 198/644
2011/0221127 A1 * 9/2011 Gal ..... B65B 61/20 271/279
2016/0304225 A1 * 10/2016 Monti ..... B65B 25/145
2017/0137158 A1 * 5/2017 Monti ..... B65B 35/40
2018/0208407 A1 * 7/2018 Ruge ..... B65G 9/004

* cited by examiner

TRANSFER DEVICE OF INFORMATION LEAFLETS

FIELD OF THE INVENTION

The present invention relates to the technical sector relating to automatic packing apparatus of products internally of boxes, for example pharmaceutical/parapharmaceuctical products contained in blister packs.

DESCRIPTION OF THE PRIOR ART

During the insertion step of the products internally of the boxes, usually an information leaflet is inserted together with the products, containing information relative to the type and characteristics of the products; for example, in the illustrated case of packing the pharmaceutical products, the information leaflet contains all the information relating to the drug's composition, the indications on doses to administrate, any side-effects, and so on.

These information leaflets are usually folded several times on themselves in bellows-fashion and have the form of a rectangular strip having a plurality of folded flaps.

The apparatus for inserting products and relative information sheets internally of corresponding boxes comprise, in a first operating zone, a series of trays which are flanked to one another and into which the products to be inserted in the boxes are supplied in succession.

These apparatus include, in a second zone contiguous to the first zone, conveyor organs that are able to convey the boxes in a fully-opened configuration with the two heads open so as to arrange the boxes with one of the two heads open in front of the relative trays.

The apparatus also include pusher means for pushing the products and transferring them from the trays into the corresponding boxes.

As cited above, during the step of inserting the products into the boxes, a contemporary insertion of the information leaflets is also included.

In this regard, the leaflets must be positioned between the trays and the boxes, in a vertical configuration that is transversal to the open heads of the boxes and the relative trays.

In this way, when the pusher means push the products from the trays towards the boxes, the products impact against the leaflets which are also pushed into the boxes, and fold about the products.

In a prior art application, the leaflets, arriving already folded in bellows-fashion from a relative storage warehouse or coming from a relative machine which has performed the folding thereof previously, are supplied one after another in a substantially horizontal configuration at a collecting station which includes a horizontal rest plane and abutting organs for blocking the advancing of the sheet.

The rest plane of this collecting station is at a first upper level, raised with respect to the level of the operating zones of the packing apparatus in which the trays are arranged to receive the products and the boxes.

A transfer device collects, one after another, the single leaflets which reach the station and which are stopped in a horizontal configuration on the rest plane, and transfer them in succession, in a vertical arrangement, to a second level, lower than the first level at which the rest plane where the leaflets arrive is located.

The second lower level, to which the leaflets are transferred and vertically-arranged, is located substantially at the same level where the operating zones of the apparatus with the trays for the products and the conveyor of the boxes are located.

A transfer device of the prior art used for carrying out these operations comprises an assembly of belts wound and predisposed in relative closed-loop pathways such as to identify at least two branches of belts which are arranged reciprocally opposite and substantially vertical so as to define between them a substantially straight vertical section for transferring the leaflets which develops starting from a first upper end and arrives at a second lower end.

The two opposite branches of belts arranged vertically are predisposed such that the first upper end of the straight vertical section is situated in proximity of the first upper level, by a side of the rest plane on which the leaflets arrive one by one.

Further, the two branches of opposite and vertical belts are predisposed and exhibit an extension such that the second end of the straight vertical section defined thereby is positioned at the second lower level: in this way the straight vertical section defined thereby develops starting from the first upper level up to arriving at the second lower level.

The transfer device of the prior art is provided, at the rest plane of the collecting station where the leaflets arrive, with deflector means which can abut and deflect a transversal end flap of the leaflet towards the first upper end of the straight vertical section of the branches of the opposite belts so that the flap is captured between the opposite branches of the belts such that the leaflet is sucked between them and is transferred downwards and towards the second lower end of the straight vertical section.

Therefore the leaflet, drawn between the two branches of the belts, is arranged vertically and follows the straight vertical section up to passing beyond the second lower end of the vertical section.

Immediately below the second end of the straight vertical section defined by the opposite branches of the belts, the prior-art device includes an abutting element for halting the vertical travel downwards of the leaflet, otherwise the leaflet, due to the continuous activation of the belts, would proceed inexorably in its travel up to being completely expelled beyond the lower second end of the straight section of the branches of the opposite belts.

In this way, as soon as the lower transversal flap of the leaflet passes the second end of this straight vertical section, it impacts against the abutment which stops it.

The transfer device further comprises a series of gripping elements which are borne, spaced at intervals by a predefined step, by a conveyor organ which is arranged such as to move the gripping elements to transit at the abutting element and further move the gripping elements up to the operating zones of the apparatus and packing for inserting the products in the boxes, and position the leaflets, in a vertical configuration, between the trays and the conveyor of the boxes.

In particular, this conveyor organ is activatable in such a way as to cause to transit, with the arrival of a leaflet against the abutting element, a relative gripping element at the abutting element so that the gripping elements can be activatable for gripping a portion of the leaflet which projects beyond the second lower end of the straight section defined by the branches of the opposite belts, and for laterally extracting it from the branches of belt and transporting it thereafter, keeping it in a vertical configuration, in a position of the operating zones of the packing apparatus positioned between a tray and a box.

Such a transfer device however exhibits some drawbacks.

Firstly, the belt must be activated at a very high velocity so as to be able to bring the leaflets to the fixed abutment at the second lower level in concordance with the transit of one of the gripping elements which in turn must be moved by the relative conveyor organ in accordance with the activating velocity of the pusher means of the packing apparatus so that the gripping elements can collect, transport and arranged the leaflets between the trays containing the products and the boxes before the pusher means are activated to perform the inserting of the products inside the boxes.

The high-velocity activation of the belts can however also lead to a relative slipping between the branches of the opposite and vertical branches and the leaflets, during the travel of the leaflets along the straight vertical section defined thereby.

This leads to a delay in the arrival of the leaflets against the abutment and therefore poor synchronism between the arrival of the leaflets against the abutment and the passage of a gripping element, and a possible consequence of this is that the leaflet is not gripped and the positioning of a leaflet between a tray and a relative box is not achieved, which leads in turn to a leaflet not being inserted in a box during the activating of the pusher means.

Further, the gripping elements for gripping and transferring the leaflets, which arrive with the lower flaps thereof transversal to the second lower level against the abutting element, transit at the abutment following an advancement section arranged substantially horizontally, i.e. with a velocity having a prevalently horizontal component.

The leaflets instead arrive against the abutting element with an advancement velocity that is substantially vertical, directed from above in a downwards direction: there are therefore difficulties in predisposing an adequate and effective synchronism between the passage of the gripping elements, which are usually of the pliers type, and which therefore must be splayed and subsequently locked on the arrival of the leaflet against the abutment.

SUMMARY OF THE INVENTION

The aim of the present invention is therefore to provide a new transfer device of information leaflets, from a first upper level, at which there is a collecting station of the leaflets with a rest plane on which the leaflets arrive one after another, to a second lower level, predisposing the leaflets vertically, at which the second lower level the operating zones of a product packing apparatus of products into the relative boxes are present, able to obviate the drawbacks mentioned herein above.

The aim is obtained by means of a transfer device of information leaflets according to claim 1.

Other characteristics advantages of the transfer device of the invention are set out in the various dependent claims.

BRIEF DESCRIPTION OF THE DRAWINGS

The characteristics of a preferred embodiment of an information leaflet transfer device of the present invention will be described in the following with reference to the FIGS., in which:

FIG. 1 also illustrates, entirely schematically, work stations (S1, S2) of the packing apparatus (A) where the products are inserted into relative boxes, and wherein the transfer device is for transferring the leaflets which reach a first upper level (L1) to a second lower level (L2), where the work stations (S1, S2) are located, predisposing the leaflets vertically and interposed between a product and a relative box.

FIG. 4A schematically illustrates, in a view from above, a significant component of the leaflet transfer device of the invention, while

FIGS. from 5A to 5H are relative schematic and perspective views of the transfer device of the invention in successive and consecutive working configurations of a leaflet transfer device at the second lower level (L2) in which the work station (S1, S2) of the packing apparatus (A) are located.

DESCRIPTION OF PREFERRED EMBODIMENTS

With reference to the accompanying figures of the drawings, reference letter (D) denotes the information leaflet transfer device of the present invention in its entirety.

Figure 1:
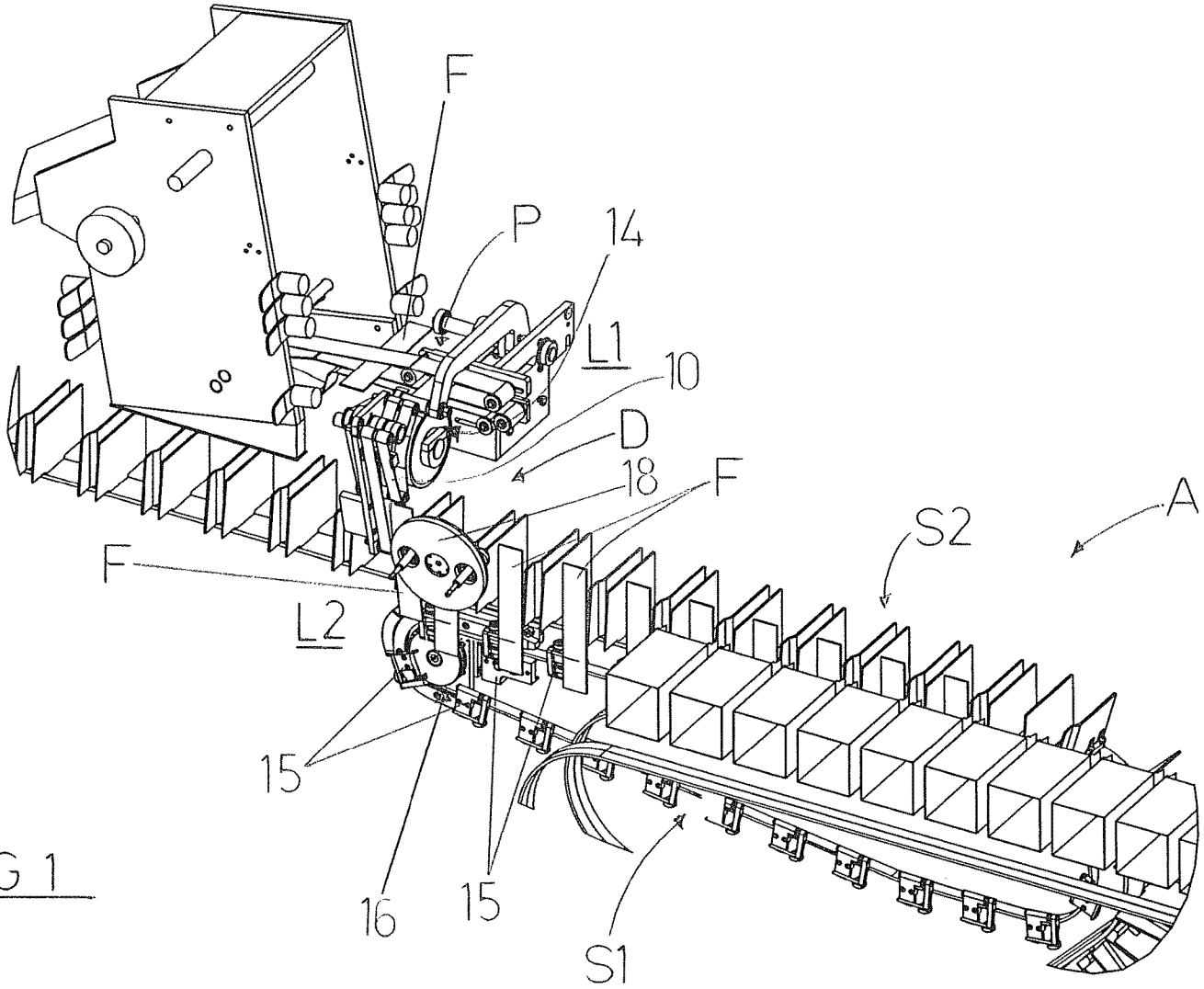
FIG. 1 illustrates, in a perspective view, the information leaflet transfer device of the invention, which is applicable and usable in a packing device which is for packing and inserting the products, together with a relative leaflet, internally of the relative boxes.
Figure 2:
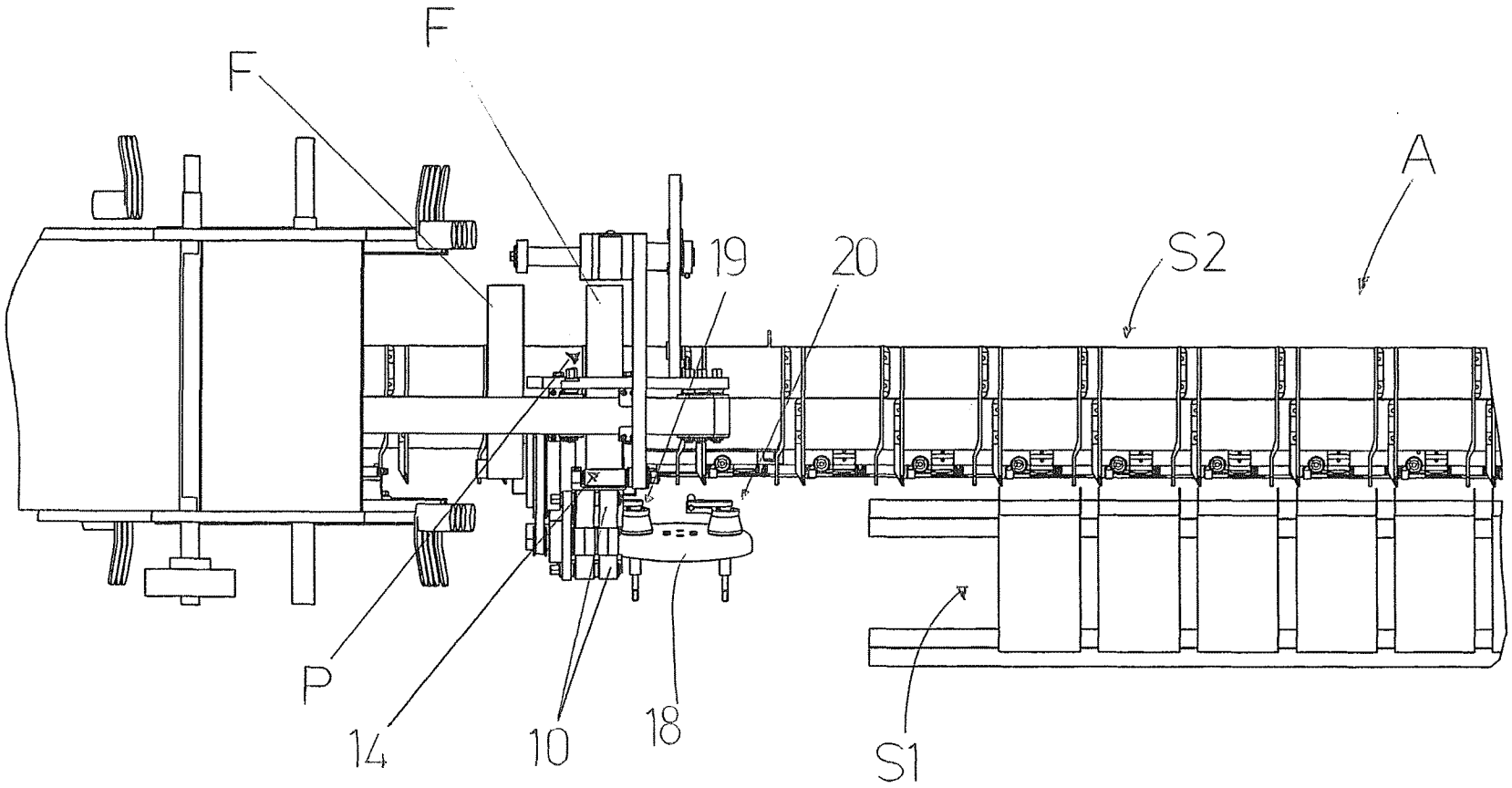
FIG. 2 is a schematic view from above of FIG. 1.

As previously mentioned, for example in the introduction of FIG. 1, the transfer device (D) is applied and is destined for use in a packing apparatus of products into boxes, where the products are to be inserted internally of the boxes together with a relative information sheet.

An example of application of the device of the present invention is the use in packing apparatus of pharmaceutical products, contained in relative blister packs, which are to be inserted internally of boxes together with an information leaflet.

FIG. 1 schematically illustrates a packing apparatus (A) which includes a first operating zone or work station (S1), where a conveyor operates which transports the boxes in an open-out configuration with the heads thereof open, and a second operating zone or work station (S2) in which a series of trays are present, into each of which the products to be inserted in the boxes are supplied.

The box conveyor transports and positions the boxes in such a way that each thereof is arranged with one of the relative heads opened in front of a relative box.

The transfer device (D) of the invention therefore has the aim of transporting and positioning a relative leaflet in a position interposed between one of the trays and a box positioned opposite the leaflet.

These sheets, denoted by reference letter (F) in the FIGS., are printed paper sheets, containing all the information relative to the type and characteristics of the product to be inserted in the boxes, which have been folded several times on itself in a bellows-fashion, so that they exhibit a rectangular-strip form, with several flaps folded on one another.

The leaflets (F) are supplied, one following another, a first upper level (L1) to a rest plane (P) for example substantially horizontally-arranged.

The work stations S1, S2) of the packing apparatus (A) are instead located at a second lower level (L2), at a lower level with respect to the rest plane (P), i.e. at a lower level than the first upper level (L1).

Therefore, the task of the transfer device (D) of the present invention is to collect the leaflets (F) from the rest plane of the first upper level (L1) and transfer them, arranging them vertically, at the second lower level (L2), where the work stations (S1, S2) of the packing apparatus (A) are located, and positioning them in interposed positions between the trays containing the products and the boxes in which the products, with the relative leaflets, are also to be inserted by means of pusher organs (not illustrated).

Figure 3:
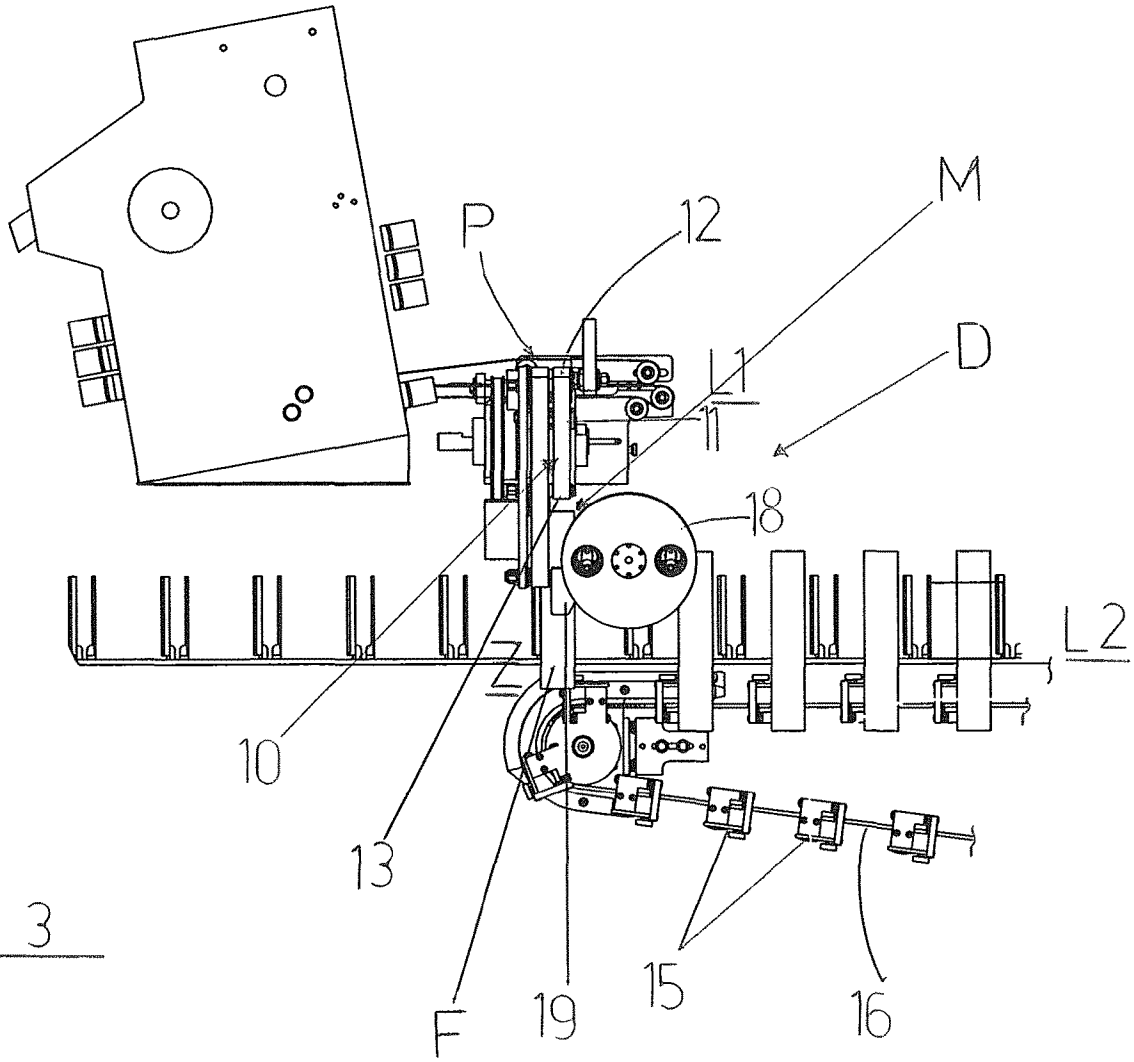
FIG. 3 is a partial lateral schematic view of FIG. 1.
Figure 4A:
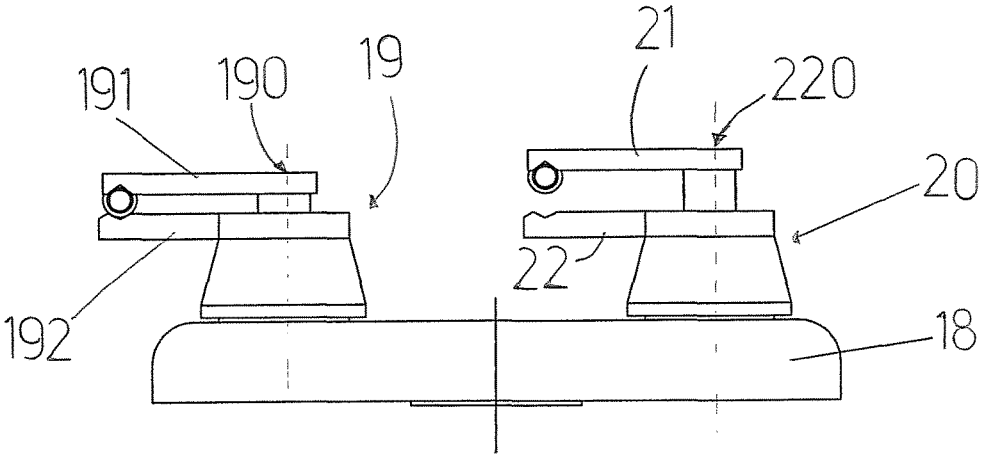
Figure 4B:
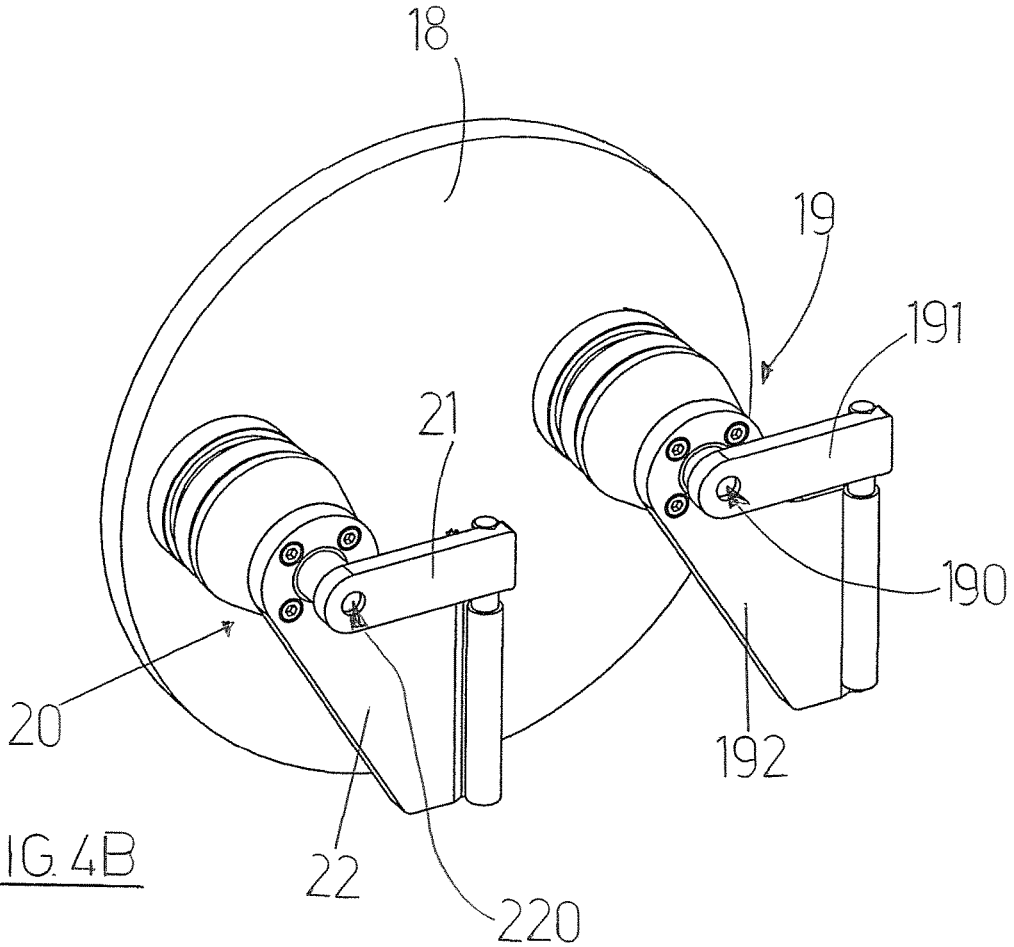
FIG. 4B illustrates the component in a perspective view.

FIG. 1 and FIG. 3 illustrate this situation, i.e. the predisposition of the rest plane (P), on which the leaflets arrive in succession one after another, which is arranged at a first upper level (L1), and the situation of the work stations (S1, S2) of the packing apparatus located on a second lower level (L2).

To perform this task, the transfer device (D) comprises at least a pair of belts (10) which are wound in a closed loop and which develop along relative winding pathways in such a way that at least two branches thereof are opposite one another and arranged substantially vertically so as to define there-between a substantially straight vertical section (11) for transferring leaflets having a first upper end (12) for infeed of leaflets and a second lower end (13) for exit of the leaflets (F).

The belts (10) are activated in such a way that the two opposite branches have an advancement direction in the straight vertical section (11) from the first upper end (12) towards the second lower end (13).

The device (D) further comprises deflector means (14), situated at the first upper level (L1) flanked to the rest plane (P) on which the leaflets (F) arrive, and positioned with respect to the first upper end (12) of the straight vertical section (11) of the two branches of opposite belts (10) in a position such that, when activated (for example following detection by a sensor of the arrival and halting of a leaflet on the rest plane (P)), they are such as to abut a transversal flap of a leaflet (F) which has come to rest on the rest plane (P) and deviate the leaflet (F) towards, and to, the first upper end (12) in such a way that the transversal flap can be captured between the two branches of opposite belts and the leaflet (F) can be drawn to follow the straight vertical section (11) towards the second lower end (13) so that it is predisposed vertically.

The device (D) further includes a series of gripping elements (15) which are borne by a relative conveyor means (16), the conveyor means (16) being arranged at the second lower level (L2) and in a position that is such as to move the gripping elements (15) so that they transit across a zone (Z) situated below the second lower end (13) of the straight vertical section (11) of the two branches of the opposite belts.

The conveyor organ (16) is further arranged and exhibits an extension such that it can convey the relative gripping elements (15) so as to transit and be positioned at the work stations (S1, S2) for transferring the products into the boxes of the packing apparatus (A), in positions located between the trays and the boxes (see for example FIG. 1 and FIG. 3).

A first special characteristic of the transfer device (D) disclosed by the invention consists in the fact that, contrarily to the prior art, the pair of belts (10) is predisposed in such a way that the relative two opposite branches arranged vertically, which between them identify the straight vertical section (11), exhibit an extension that is such that the second lower end (13) of the straight vertical section (11) is arranged in a distant position from the second lower level (L2) and distant from the zone (Z) from which the gripping elements transit.

In this way, contrarily to the prior art where the extension of the belts was such that the second lower end of the straight section was located exactly at the second lower level (L2), with the device of the invention (D), a free manoeuvring space (M) is present between the second lower end (13) of the straight section (11) of the two branches of the opposite belts and the passage zone (Z) of the gripping elements (15).

A further peculiarity of the device (D) of the invention consists in the fact that it comprises a drum element (18) having a rotation axis and at least a first pliers gripping means (19), borne by the drum (18), having two gripping arms (191, 192) which are pivoted to one another in a common fulcrum (190) and are rotatable about the common fulcrum (190).

The drum element (18) is predisposed in a position that is such that when set in rotation about the relative rotation axis, the gripping means (19) is set in rotation about the rotation axis with the common fulcrum (190) of the relative two gripping arms (191, 192) which is moved along a circumference (C) (for example schematised with a broken line in FIGS. from 5A to 5H), so that the two gripping arms (191, 192):

when the relative common fulcrum (190) follows a first arc of this circumference, transit at the free space (M) below the second lower end (13) of the leaflet transfer straight vertical section (11);

and when the common fulcrum (190) follows a second arc of circumference following the first arc in the rotation direction of the drum (18), are above the zone (Z) where the gripping elements (15) of the leaflets transit in the second lower level (L2).

Further, the pliers gripping means (19) are predisposed and mounted on the drum (18) in such a way that during rotation of the drum (18) about the relative rotation axis, the relative two gripping arms (191, 192) are activated in counter-rotation with respect to the rotation of the drum, about the relative common fulcrum (190) so that they always maintain the same spatial orientation.

In order to carry out the gripping of the leaflet (F) from the straight section (11) of the two branches of belts and the following transfer and release to the gripping elements (15) of the conveyor organ (16), the two gripping arms (191, 192) are predisposed and configured so as:

to be splayed and subsequently be locked, during the transit of the common fulcrum (190) at the first arc of circumference, so as to clamp there-between a portion of the lower flap of a leaflet (F), which has been transported in a vertical configuration by the opposite branches of the belts (10) beyond the second lower end (13) of the straight vertical section (11), and so as to extract the leaflet (F) from the two branches of belt, to be subsequently newly splayed at the transit of the common fulcrum (190) along the second arc of circumference so as to release the sheet (F) still in a vertical configuration (since, as mentioned above, the two arms always maintain the same spatial orientation during the rotation of the drum (18)), so that it can be gripped by a corresponding gripping element (15) of the gripping elements (15) in transit from the zone (Z) and then transferred by the gripping element (15) to one of the work stations (S1, S2) of the packing apparatus for insertion thereof together with a product in a relative box.

Thanks to this peculiarity, the transfer device (D) of the invention exhibits a straight section (11) for transfer of the leaflets (F) having a small and lower extension with respect to the prior-art devices, which enables activating the belts defining this straight section with an advancement velocity that is lower with respect to the prior art: this enables preventing the onset of undesired slipping of the leaflets.

The opportunity of being able to activate the belts with a lower velocity is enabled by the special use of the drum element (18) provided with the pliers gripping organ (19), which by means of the relative two gripping arms (190, 191), once the leaflet (F) has been gripped, extracts it, takes it and accompanies it, following a circular pathway imposed by the movement of the common fulcrum (190) along a circumference (C) which has a centre at the rotation axis of the drum up to a position above a gripping element (15) of the conveyor means (16), thus obviating the problems present in the prior-art devices in relation to the synchronization between a strictly vertical movement of the advancement of the leaflets in a downwards direction along the belts and a strictly horizontal movement of the advancement of the gripping elements (15) moved by the conveyor means.

In fact, when the common fulcrum (190) between the two gripping arms (191, 192) of the gripping organ (19) follows the second arc of circumference, the two gripping arms (191, 192), with the leaflet gripped between them, "follow" the gripping element (15) advancing in the zone (Z), and therefore the transfer operations of the leaflet (release of the leaflet by the two gripping arms and gripping of the leaflet by the gripping element (15)) are easier and simpler to synchronise.

The modalities with which the two gripping arms (191, 192) are predisposed in and mounted on the drum element (18), so that during the rotation of the drum (18) they rotate counter-rotatingly with respect to the rotation direction of the drum (18), can be realized in various ways, predisposable with no difficulty by a technical expert in the sector, for example using epicyclic gears.

In the same way, the modalities with which the two gripping arms (191, 192) are predisposed and configured on the drum (18) so as to splay and subsequently be locked, during the transit of the common fulcrum (190) at the first arc of circumference (i.e. during the transit thereof in the free space (M) present immediately below the second lower end (13) of the straight section (11) of the two branches of belts), and to splay during the transit by the common fulcrum (190) thereof of the second arc of circumference (i.e. during the transit thereof above the passage zone (Z) of the gripping elements) can be realised in various ways, predisposable with no difficulty on the part of the technical expert in the sector, for example the two gripping arms can be kept locked by action of springs, and include the presence of special cam pathways which force the springs so as to splay the two arms at precise points of the pathway thereof, and newly lock the two arms once these points have been passed.

FIGS. from 5A to 5H schematically illustrate the above-described gripping and extraction steps, by the two gripping arms (191, 192) of the gripping organ (19), of a leaflet (F) from the lower end (13) of the straight section (11) of the two branches of opposite belts and the subsequent release by the two arms of the sheet at the transit thereof at the zone (Z) and the contemporary gripping of the sheet (F) by a gripping element (15) which is made to transit by the conveyor means (16) at the zone.

Figure 5A:
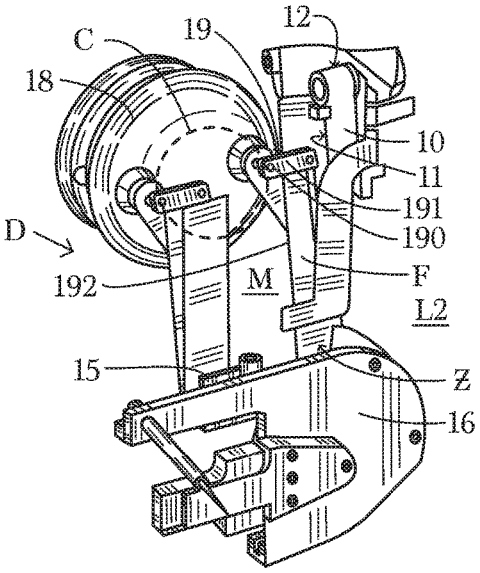
Figure 5C:
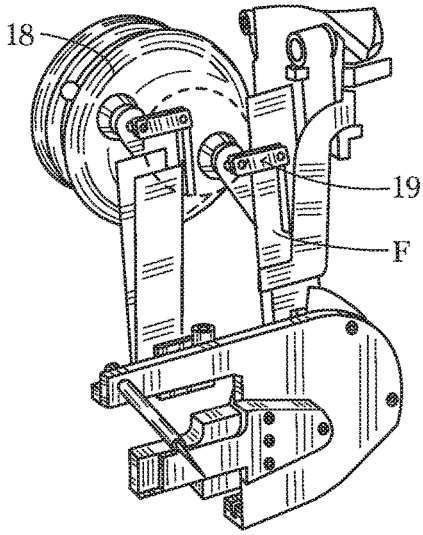
Figure 5B:
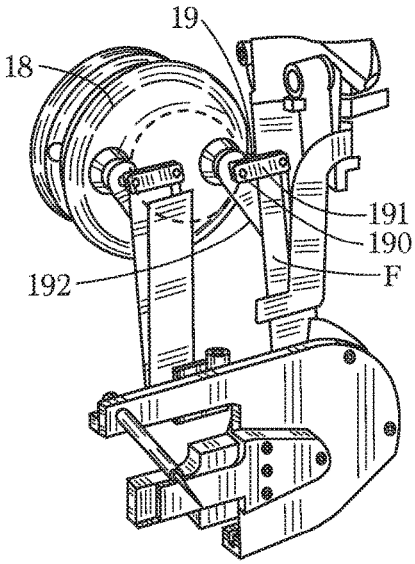
Figure 5D:
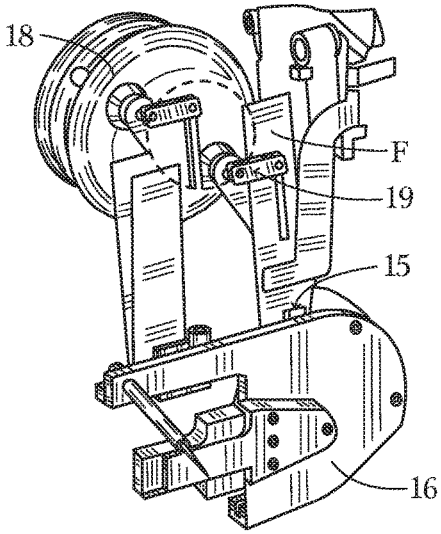
Figure 5E:
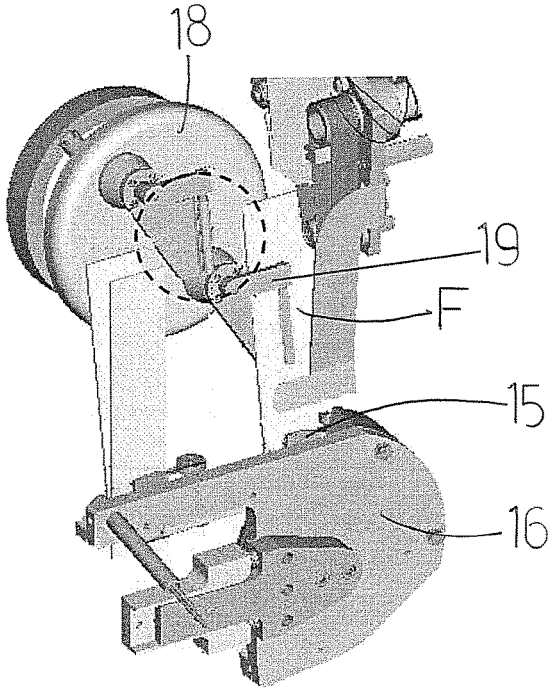
Figure 5F:
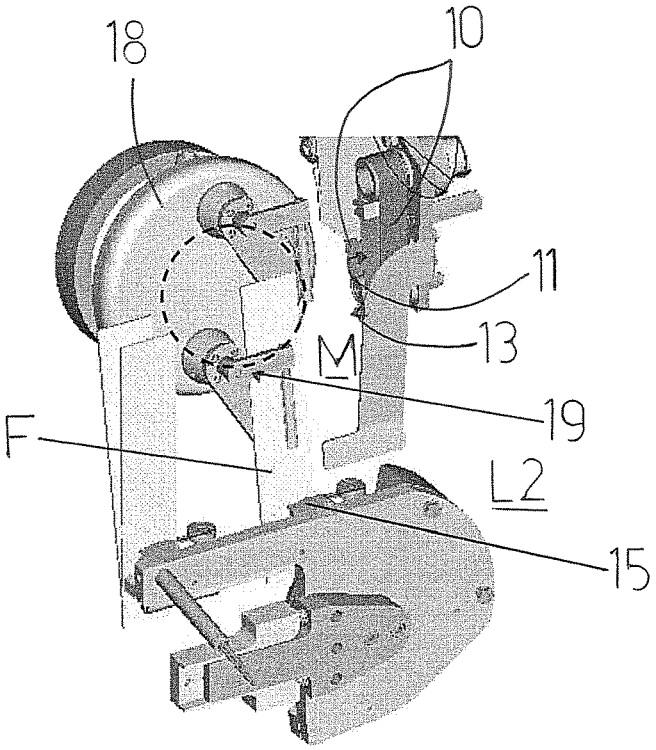
Figure 5G:
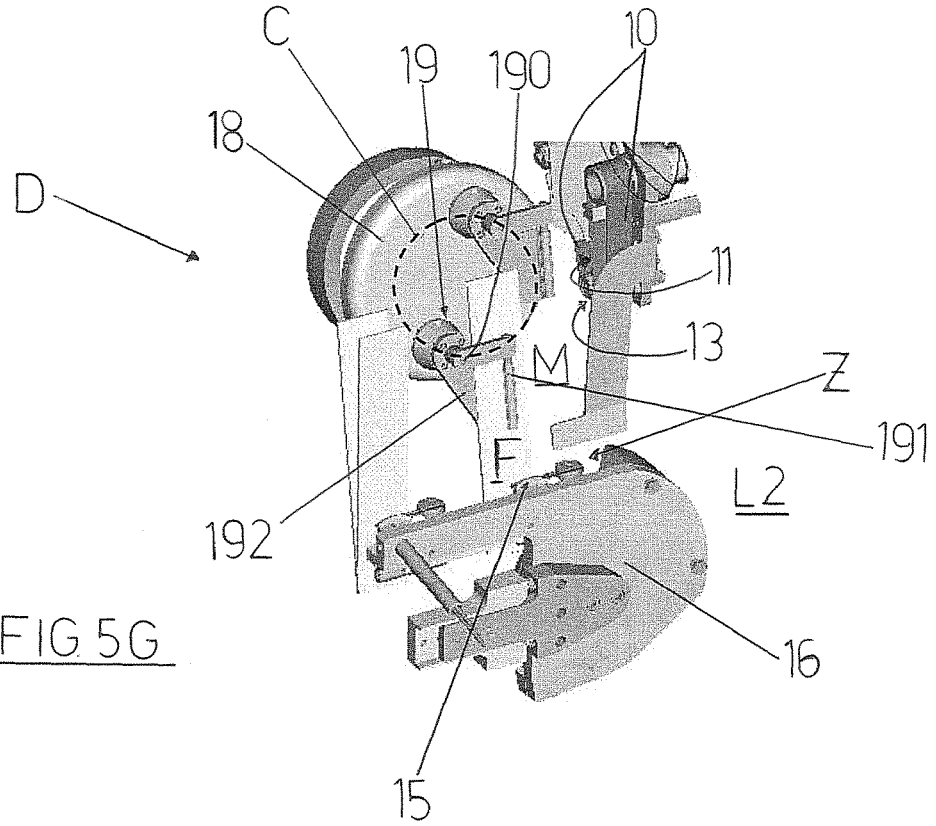
Figure 5H:
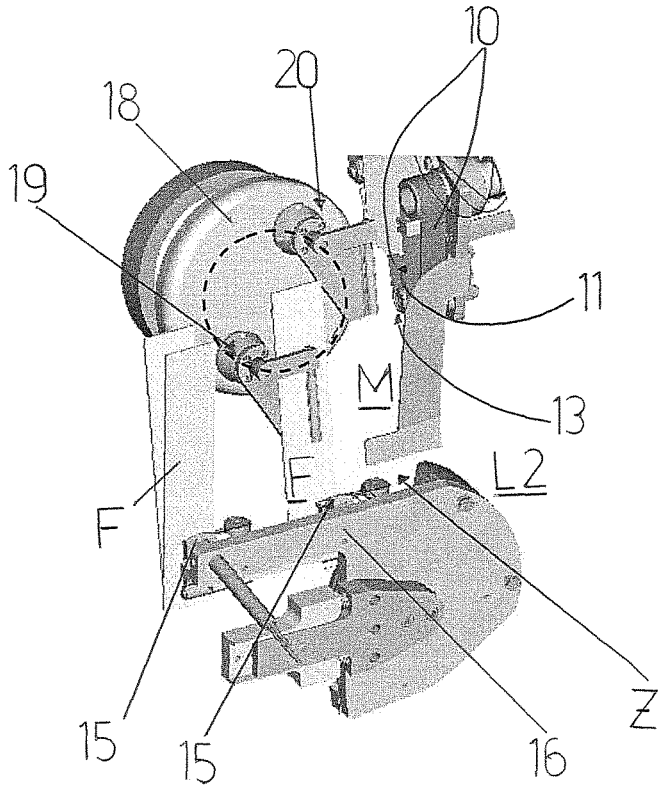

In Detail:

FIGS. 5A and 5B illustrate the passage of the common fulcrum (190) of the two gripping arms (191, 192) of the gripping organ (19) at the first arc of circumference such that the two gripping arms (191,192) transit below the second lower end (13) of the straight section (11) of the two branches of the opposite belts, the two gripping arms (191, 192) first being splayed and then locked such as to grip the lower flap of a leaflet (F) which has in the meantime been transported by the straight section (11) of the two branches of belts beyond the relative second lower end (13);

FIGS. from 5C to 5E show successive positions of the two gripping arms (191, 192) in which they have performed the extraction of the leaflet (F) from the two branches of belts;

FIGS. 5F to 5H illustrate the passage of the common fulcrum (190) of the two gripping arms (191, 192) of the gripping organ (19) at the second arc of circumference such that the two gripping arms (191, 192) transit above a gripping element (15) of the conveyor organ (16) in transit from the zone (Z) to the second lower level (L2) with the two arms in concordance with the passage of the common fulcrum (190) thereof along the second arc of circumference which are splayed so as to release the leaflet (F) which is gripped by the gripping element (15) (FIG. 5H) and subsequently transferred thereby towards the work stations (S1, S2) of the packing apparatus into a position interposed between a tray and a box.

Further characteristics of the transfer device (D) of the invention are set out in the following.

In greater detail, the two arms (191, 192) of the gripping organ (19) are predisposed and borne by the drum (18) in such a way that when the relative common fulcrum (190) follows the first arc of circumference they are splayed and then locked so as to grip a portion of the lower flap of a leaflet (F) which in the meantime has been transported by the two branches of facing belts beyond the second lower end (13) of the straight vertical section (11), to a point of the first arc of circumference a tangent of which is orientated vertical and parallel to the straight vertical section (11).

In this way, the rotation velocity of the two gripping arms (191, 192) exhibits prevalent velocity component that is parallel to and directed in a same direction as the transfer velocity of the leaflet (F) along the straight vertical section (11).

Further, the two gripping arms (191, 192) of the gripping means (19) are further predisposed and borne by the drum (18) in such a way that when the relative common fulcrum (190) follows the second arc of circumference in a position above the transit zone (Z) of the gripping elements (15), they are splayed, so as to release the leaflet (F), at a point of the second arc of circumference the tangent of which is orientated parallel to the advancement direction of the gripping elements (15).

In this way, the rotation velocity of the two gripping arms (191, 192) has a prevalent component velocity parallel to and directed in the same direction as the advancement velocity of a corresponding gripping element (15), which facilitates the passage of the leaflet (F) from the two gripping arms (191, 192) to the gripping element (15).

More in particular, the drum (18) is predisposed to be activated in rotation about the axis thereof with a rotation velocity that is such that the two gripping arms (191, 192) arrive with the relative common fulcrum (190) at the above-cited tangential point of the first arc of circumference, wherein the tangent to the first arc is parallel to the straight vertical section (11) of the belts, in concordance with the exit of a lower flap of a sheet (F) from the second lower end (13) of the straight vertical section (11), and such that they exhibit in this tangential point a velocity component in the tangential direction that is greater than the transfer velocity of the belts of the straight vertical section (11).

In this way the extraction of the leaflet (F) from the two branches of belts by the two gripping arms (191, 192) is easier and faster.

Further, the drum (18) is predisposed such that the rotation velocity of the drum (18) about the rotation axis thereof is also such that the two gripping arms (191, 192) arrive with the relative common fulcrum (190) at the above-cited tangential point of the second arc of circumference, wherein the tangent to the second arc is parallel to the advancement direction of the gripping element (15) in concordance with the transit of a corresponding gripping element (15), and such that they exhibit at this tangential point a velocity component in the tangential direction substantially corresponding to the advancement velocity of the gripping element (15).

Clearly this simplifies and makes much easier the passage modalities of the leaflets (F) from the two gripping arms (191, 192) to the gripping element (15).

According to the particular operating and production requirements, the device (D) can comprise a second gripping organ of the pliers type (20), borne by the drum (18), having two gripping arms (21, 22) pivoted to each other in a common fulcrum (220) and rotatable about the common fulcrum (220), and predisposed so that the common fulcrum (220) is in a diametrically opposite position to the rotation axis of the drum with respect to the common fulcrum (190) of the gripping arms (191, 192) of the first gripping organ (19).

The second gripping organ (20), like the first gripping organ (19), is predisposed and mounted on the drum (18) so that during the rotation of the drum (18) about the relative rotation axis the relative two gripping arms (21, 22) are activated in counter-rotation with respect to the rotation of the drum (18), about the relative common fulcrum (220) in such a way that they always maintain the same spatial orientation.

The two gripping arms (21, 22) of the second gripping organ (20) are also predisposed so as to be splayed, and thereafter to be locked, during the transit of the common fulcrum (220) thereof at the first arc of circumference, so as to grip between them a lower flap of a sheet (F) which has been transported in a vertical configuration by the opposite branches of the belts (10) beyond the second lower end (13) of the straight vertical section (11) and extract the sheet (F) from the two branches of belt, and further predisposed in such a way as to be subsequently newly splayed at the transit of the common fulcrum (220) along the second arc of circumference in such a way as to release the sheet (F) in the vertical configuration (as the two arms always maintain the same spatial orientation during the rotation of the drum) so that it can be gripped by a corresponding gripping element (15) of the gripping elements (15) transiting from the zone (Z).

Alternatively, against according to the special operating and production requirements, the device (D) can be conceived so that three gripping organs can be predisposed, each having two gripping arms pivoted to one another in a common fulcrum, the common fulcra being arranged at 120° between them along a common circumference about the rotation axis of the drum (18).

The invention claimed is:

1. A transfer device for transferring leaflets, folded bellows-fashion and having a shape of a rectangular strip with a plurality of folded flaps, the transfer device comprising:

a horizontal rest plane or surface at a first upper level receiving the leaflets one after another, the leaflets resting horizontally on the horizontal rest plane or surface and being conveyed abutting against an abutment;

a series of gripping elements borne by a conveyor, the conveyor being arranged at a second lower level, where work stations of a packing apparatus are located, the work stations inserting products into respective boxes, the leaflets being transferred and arranged vertically to be gripped by the gripping elements of the conveyor at the second lower level and subsequently positioned at the work stations so as to be insertable together with the products into the respective boxes;

at least a pair of belts which are wound in a closed loop and which develop along relative winding pathways in such a way that at least two branches thereof are opposite one another and arranged substantially vertically so as to define there-between a substantially vertical straight section for transferring the leaflets having a first upper end for infeed of the leaflets and a second lower end for exit of the leaflets, the belts being activated in such a way that the at least two opposite branches have an advancement direction in the straight substantially vertical straight section from the first upper end towards the second lower end;

deflector means, situated at the first upper level flanking the horizontal rest plane or surface on which the leaflets arrive, the deflector means being positioned with respect to the first upper end of the substantially vertical straight section of the at least two opposite branches of the belts in a position such that, when activated, the deflector means abut a transversal flap of a leaflet which has come to rest on the horizontal rest plane or surface against the abutment and deviate the transversal flap of the leaflet downwards and towards the first upper end in such way that the transversal flap can be captured between the at least two opposite branches of the belts and the leaflet can be drawn to follow the substantially vertical straight section towards the second lower end so that the leaflet is predisposed substantially vertical, wherein the conveyor is arranged at the second lower level below the first upper level and located at a position such as to move the gripping elements so that the gripping elements transit across a transit zone situated below the second lower end of the substantially vertical straight section of the at least two opposite branches of the belts, and the gripping elements are positioned at the work stations for transferring the products into the respective boxes of the packing apparatus, wherein the at least a pair of belts is predisposed so that the at least two opposite branches arranged substantially vertically exhibit an extension that is such that the second lower end of the substantially vertical straight section is arranged in a position above and away from the second lower level and the transit zone from which the gripping elements transit such that a free maneuvering space is between the second lower end and the transit zone;

a drum element having a rotation axis and at least a first pliers gripping means, the at least a first pliers gripping means including two gripping arms borne by the drum element, the two gripping arms being pivoted to one another in a common fulcrum on the drum element and being rotatable about the common fulcrum, the drum element being predisposed in a position between the second lower end of the at least a pair of belts and the conveyor such that when the drum element is set in rotation about the rotation axis, the at least a first pliers gripping means is set in rotation about the rotation axis of the drum element with the common fulcrum of the two gripping arms, the common fulcrum of the two gripping arms being moved along a circumference, in such a way that the two gripping arms, when the common fulcrum follows a first arc of the circumference, transit at the maneuvering free space from a higher position at the second lower end of the substantially vertical straight section of the belts to a first lower position towards the transit zone, and so that the two gripping arms, when the common fulcrum follows a second arc of the circumference following the first arc of the circumference in the rotation direction of the drum element, are at a second lower position lower than the first lower position and above the transit zone where the gripping elements of the leaflets transit in the second lower level, the at least a pliers gripping means being predisposed and pivotally mounted about the common fulcrum on the drum element in such a way that during rotation of the drum element about the rotation axis, the two gripping arms of the at least a first pliers gripping means are activated in counter-rotation with respect to the rotation of the drum element, about the common fulcrum so that the at least a first pliers gripping means always maintain a same spatial orientation, the two gripping arms being predisposed and configured so as to be splayed and subsequently be locked, during a transit of the common fulcrum along the first arc of the circumference from the higher position to the first lower position, so as to clamp there- between a portion of a lower flap of a leaflet, which has been transported in a substantially vertical configuration by the at least two opposite branches of the belts beyond the second lower end of the substantially vertical straight section, and so as to extract the leaflet from the at least two opposite branches of the belts, and further predisposed and configured so as to be subsequently newly splayed at the transit of the common fulcrum along the second arc of the circumference at the second lower position above the transit zone so as to release the leaflet still in the substantially vertical configuration so that the leaflet can be gripped by a corresponding gripping element of the gripping elements in transit from the transit zone and then transferred by the corresponding gripping element to one of the work stations of the packing apparatus for insertion thereof together with a product in a relative box.

2. The device of claim 1, wherein the two gripping arms of the at least a first pliers gripping means are predisposed and borne by the drum element in such a way that when the common fulcrum thereof follows the first arc of circumference, from the higher position to the first lower position, the gripping arms are first splayed and then locked, so as to grip the portion of a lower flap of a leaflet which has been transported by the at least two opposite branches of the belts beyond the second lower end of the substantially vertical straight section, to a first point of the first arc of the circumference a tangent of which is orientated vertically and parallel to the substantially vertical straight section, so that a rotation velocity of the two gripping arms has a prevalent velocity component that is parallel to and directed in a same direction as a transfer velocity of the leaflet along the substantially vertical straight section, and wherein the two gripping arms of the at least a first pliers gripping means are further predisposed and borne by the drum element in such a way that, when the common fulcrum follows the second arc of the circumference, at the second lower position above the transit zone of the gripping elements, the two gripping arms are splayed, so as to release the leaflet, at a second point of the second arc of circumference the tangent of which is orientated parallel to the advancement direction of the gripping elements, so that the rotation velocity of the two gripping arms has the prevalent component velocity parallel to and directed in the same direction as an advancement velocity of the corresponding gripping element.

3. The device of claim 2, wherein the drum element is predisposed to be activated in rotation about the rotation axis thereof with the rotation velocity that is such that the two gripping arms arrive with the common fulcrum at the first point of the first arc of the circumference, wherein the tangent to the first arc of the circumference is parallel to the substantially vertical straight section of the belts, in concordance with an exit of a lower flap of a leaflet from the second lower end of the substantially vertical straight section, and such that the two gripping arms exhibit at the first point a velocity component in the tangential direction that is greater than a transfer velocity of the belts of the substantially vertical straight section in such a way as to remove the leaflet from the belts, with the rotation velocity of the drum element about the rotation axis being further such that the two gripping arms arrive with the common fulcrum at the second point of the second are of the circumference, wherein the tangent to the second arc of the circumference is parallel to the advancement direction of the gripping elements in concordance with a transit of the corresponding gripping element, and such that the two gripping arms exhibit at the second point a velocity component in the tangential direction substantially corresponding to the advancement velocity of the corresponding gripping element.

4. The device of claim 1, further comprising a second pliers gripping means, borne by the drum element, having two gripping arms pivoted to each other in a common fulcrum and rotatable about the common fulcrum, and predisposed so that the common fulcrum is in a diametrically opposite position to the rotation axis of the drum element with respect to the common fulcrum of the gripping arms of the at least a first pliers gripping means, the second gripping means being predisposed and mounted on the drum element so that during rotation of the drum element about the rotation axis the two gripping arms are activated in counter-rotation with respect to rotation of the drum element, about the common fulcrum in such a way that the two gripping arms always maintain the same spatial orientation, the two gripping arms of the second pliers gripping means being predisposed so as to be splayed, and thereafter to be locked, during the transit of the common fulcrum thereof at the first arc of the circumference, so as to grip a lower flap of a leaflet which has been transported in a vertical configuration by the at least two opposite branches of the belts beyond the second lower end of the substantially vertical straight section and extract the leaflet from the at least two opposite branches of the belts, and further predisposed in such a way as to be subsequently newly splayed at the transit of the common fulcrum along the second arc of circumference in such a way as to release the leaflet in the vertical configuration so that the leaflet can be gripped by a corresponding gripping element of the gripping elements transiting from the transit zone.

5. The device of claim 1, further comprising three gripping mechanisms each having two gripping arms pivoted to one another in a common fulcrum, the common fulcra being angularly spaced from one another by 120° along a common circumference about the rotation axis of the drum element.

* * * * *